US007415863B2

(12) United States Patent
Katzfuss et al.

(10) Patent No.: US 7,415,863 B2
(45) Date of Patent: Aug. 26, 2008

(54) CLAMPING DEVICE

(76) Inventors: Klaus Katzfuss, Eduard-Von-Hartmann-Strasse 7, D-04157 Leipzig (DE); Egbert Eurich, Am Fuchsgrund 19, D-09337 Hohenstein-Ernstthal (DE)

( * ) Notice: Subject to any disclaimer, the term of this patent is extended or adjusted under 35 U.S.C. 154(b) by 353 days.

(21) Appl. No.: 10/520,216

(22) PCT Filed: Jun. 27, 2003

(86) PCT No.: PCT/EP03/06801

§ 371 (c)(1),
(2), (4) Date: Aug. 12, 2005

(87) PCT Pub. No.: WO2004/004939

PCT Pub. Date: Jan. 15, 2004

(65) Prior Publication Data

US 2006/0090529 A1 May 4, 2006

(30) Foreign Application Priority Data

Jul. 4, 2002 (DE) ..... 102 30 071
Jul. 6, 2003 (DE) ..... 203 08 856

(51) Int. Cl.
*B21D 22/12* (2006.01)
*B30B 1/00* (2006.01)

(52) U.S. Cl. ..... 72/455; 72/60; 100/214; 100/228; 100/231

(58) Field of Classification Search ..... 72/455, 72/456, 57, 61; 100/214, 228, 231

See application file for complete search history.

(56) References Cited

U.S. PATENT DOCUMENTS

| | | | | |
|---|---|---|---|---|
| 3,643,592 | A * | 2/1972 | Blaser | 100/214 |
| 3,884,142 | A * | 5/1975 | Jonsson | 100/214 |
| 3,992,837 | A * | 11/1976 | Dahlman et al. | 72/455 |
| 4,155,476 | A * | 5/1979 | Lipiec et al. | 425/77 |
| 4,878,374 | A * | 11/1989 | Nelson | 72/446 |
| 6,488,109 | B1 | 12/2002 | Igaki et al. | |
| 7,150,171 | B2 * | 12/2006 | Hellgren | 72/63 |

FOREIGN PATENT DOCUMENTS

| | | |
|---|---|---|
| DE | 196 02 490 A1 | 7/1997 |
| EP | 0 050 520 A1 | 4/1982 |
| EP | 1 075 882 A2 | 2/2001 |
| WO | WO 00/58040 | 10/2000 |

* cited by examiner

*Primary Examiner*—David B Jones
(74) *Attorney, Agent, or Firm*—Laurence A. Greenberg; Werner H. Stemer; Ralph E. Locher

(57) ABSTRACT

The invention concerns a clamping device for a device for the production of metal parts by forming with a closed forming tool, the clamping device comprising at least several tension hoops (2), these tension hoops (2) each being provided with at least one tension frame (2.2) of a closed contour, the tension frame being provided with two segments (2.3) arranged opposite each other at some distance, between which a forming tool (12) can be arranged, each of these segments (2.3) being provided with at least either one bearing surface (2.1) or one bearing surface (2.4), and the tension hoops (2) being each linked by at least one articulated joint (8) in order to be pivoted, a bearing surface (3.1) which is located above or on the upper surface of the forming tool (12) and used as support for a bearing surface (2.1) of a tension hoop (2), and a device (5) which generates a clamping force of more than 3 MN and is composed of several power-generating elements.

13 Claims, 4 Drawing Sheets

CLAMPING DEVICE

Figures 1A, 1B:
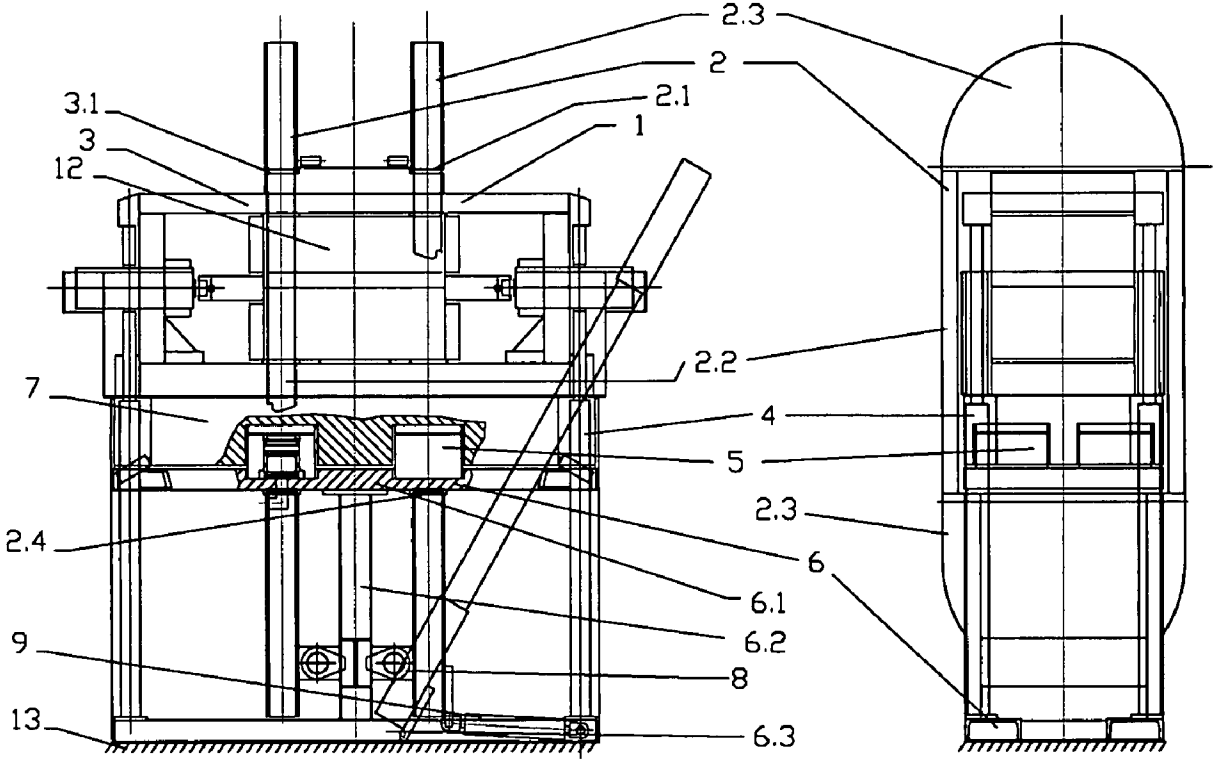

The invention concerns a clamping device for a device for the production of metal parts by forming with a closed metal forming tool as well as a device for the production of metal parts by forming with a closed forming tool which is provided with the clamping device specified in the invention. The invention also concerns a structural component for a clamping tool of a device for the production of metal parts by forming with a closed forming tool.

As used in the invention, the designation of "metal forming with a closed forming tool" defines all metal forming procedures during which the application of a force to the workpiece to be formed occurs inside a forming tool which is essentially composed of several parts but which is substantially closed at the moment of the application of the force, and during which the forces to lock the forming tool are regularly higher than 3 MN, an example of such a forming procedure being the so-called hydroforming process using forming tools which are parted in a longitudinal direction.

In hydroforming processes, the devices used will generally be powered by hydraulic systems. The arrangement of such devices is largely determined by the workpiece to be produced, and the original forming body will always be a tube-shaped hollow body. The main cylinders used for power transmission to the tube extremities will be arranged either in an upright or a horizontal position so that they act in opposite directions in the direction of the initial tube axis. One of these cylinders will generally be provided with a hollow bore and a high pressure connection which is generally connected to the pressure intensifier by means of a pipe joint.

The forming tool has at least two components. In the simplest scenario of a two-part forming tool, one tool component is secured to the machine table, whilst the other is powered and performs an opening and closing motion as defined by the working cycles. Depending on the desired workpiece geometry, the devices can optionally take up forming tools which are either parted in the longitudinal or cross direction; where clamping forces of more than 3 MN will generally require forming tools which are parted in a longitudinal direction. Mostly, those devices will only be of economic value where higher numbers of pieces are produced, that is especially where short working cycles are used.

In many cases, the devices for hydroforming processes which are provided with a forming tool which is parted in the longitudinal direction down the tube axis are designed as multicolumn presses or frame presses. The forming tool is mounted so that the plunger of the press moves one component of the forming tool up during tool change. During the forming process, the plunger should compensate the force resulting from the workpiece surface area projected and the interior pressure and apply a force of at least the same value or higher to the forming tool. Due to the high interior pressures used in the process (generally more than 1000 bar), the clamping forces required in this respect which are higher than 3 MN must be ensured by the steel structure of the device, which will require relatively high constructional heights and much space for assembly and operating purposes when using multicolumn presses or frame presses. The device will involve costly foundation work and large space requirements where the forces to be absorbed are 3 MN or higher and the dead mass generally resulting from such structures is accordingly high. Any tool change, including that of the forming tool, will be subject to high technological expenditure.

The publication DE 1 602 475 B2 describes a pressing device for the production of hollow workpieces constructed of sheet metal under interior hydraulic pressure by cold forming processes where the moveable parts of the parted mould encompassing the workpiece are locked together by means of pivotable clamping hooks during cold forming. Where such a pressing device is required to ensure clamping forces of more than 1 MN, in particular more than 3 MN, the clamping mechanism, in particular the clamping hooks or joints which are needed for the pivoting motion of the clamping hooks, must be sufficiently dimensioned. Such devices of a dead mass of several metric tons must be based on expensive foundations and will have large overall construction heights. The clamping hooks, as far as they are able to guarantee the required clamping forces in the first place, can only be operated with heavy forces and high energy.

The short cycle times of between 20 and 40 seconds which are an economic necessity for a profitable operating of the device within industrial manufacturing processes, are not realistic in view of the high moments of inertia occurring. This solution will result in the formation of gaps between the components of the forming tool produced during the forming process proper, which mainly results from the elastic deformation of the material used for the clamping hooks, and which will lead to an undesired deformation of the workpiece during power build-up.

It is the aim of the invention to provide both a device and a component of such a device which have a lower construction height and a low dead mass and will require a lower expenditure regarding the amounts of investment, maintenance and operation and can be operated in an economical way and which are not subject to forming gaps between the components of the forming tool during forming.

The requirement of the invention is met because the clamping device according to the invention comprises at least:

- several tension hoops 2, these tension hoops 2 each being provided with a tension frame 2.2 of a closed contour, the tension frame being provided with two segments 2.3 arranged opposite each other at some distance, between which a forming tool 12 can be arranged, each of these segments 2.3 being provided with at least either one bearing surface 2.1 or one bearing surface 2.4, and the tension hoops 2 being each linked by at least one articulated joint 8 in order to be pivoted, the material of the tension frame 2.2 mainly consisting of materials of tensile strengths between 1500 N/mm$^2$ and 4200 N/mm$^2$, an endurance strength of between 1200 N/mm$^2$ and 3000 N/mm$^2$ and a density of between 1.2 and 2.5 g/cm$^3$,
- a bearing surface 3.1 which is arranged above or on the upper surface of forming tool 12 and is used as support for a bearing surface 2.1 of a tension hoop 2, and
- a device 5 which produces a clamping force of more than 3 MN and is composed of several power-generating elements, the clamping force being applied between the bearing surfaces 2.1 and 2.4 of the tension hoops 2 and at least one surface area located beneath forming tool 12.

The selection of materials of the invention and the constructional design of the material will, on the one hand, allow for a technically easy pivoting of the tension hoops using a low amount of energy in order to obtain reasonable cycle times, and, on the other, result in the occurring of a low amount of dynamic forces.

The fact that the invention makes use of and selects materials as construction materials, the properties of which are described in the first patent claim, makes way for new constructive solutions and/or new machine designs, as compared to the materials used in forming technology up to date, including structural steel.

The tensile strength of a carbon fiber compound is, for instance, of approx. 2950 N/mm$^2$ (structural steel of approx.

between 320 and 690 N/mm$^2$), the endurance strength of approx. 1950 N/mm$^2$ (structural steel of approx. 350 N/mm$^2$), and the density of approx. 1.8 g/cm$^3$).

By designing the element of clamping mechanism as a tension hoop which will provide the required clamping force the invention makes a purposeful use of the improved material properties of the materials preferred in the invention, such as carbon fiber compounds, which results in the proportion between the strength of the design and the tension frame mass being 800, for instance.

The depending Patent claims 2 to 8 indicate advantageous further developments and improvements of the clamping device under the invention.

The requirements of the invention are furthermore met by a device for the production of metal parts by hydroforming which comprises at least one parted forming tool and a device as described under Patent claims 1 to 8.

The requirements of the invention are furthermore met by a structural component for a clamping tool of a device for the production of metal parts by hydroforming where a closed forming tool as described under Patent claims 10 is used.

The depending Patent claim 11 describes advantageous developments and improvements of the structural component as described in the invention.

The drawing shows an example of the design of the invention which is specified in detail in the description below.

It includes:

FIG. 1*a* Side view of a clamping device

FIG. 1*b* Another side view of a clamping device as in FIG. 1*a*

Figure 2A:
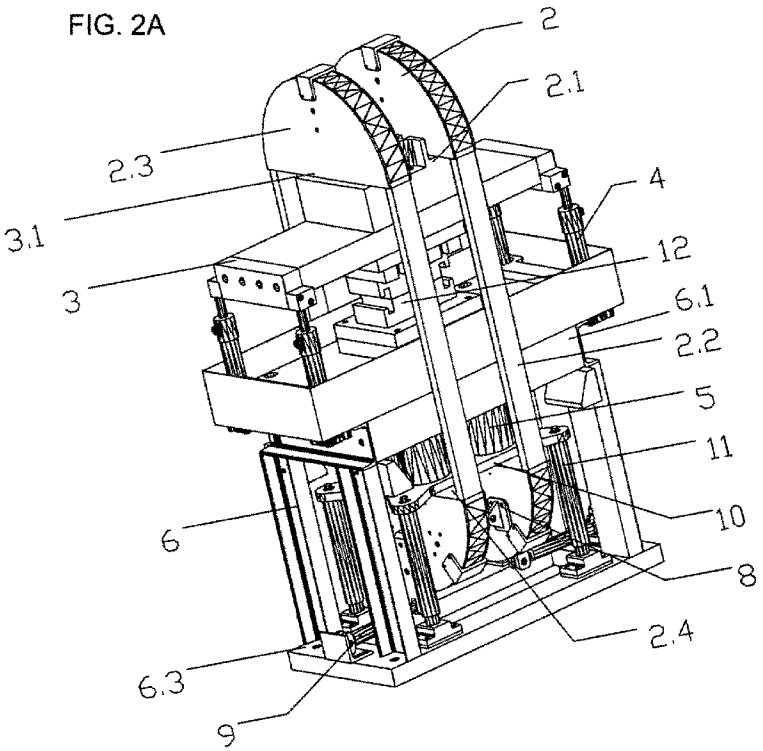
Figure 2B:
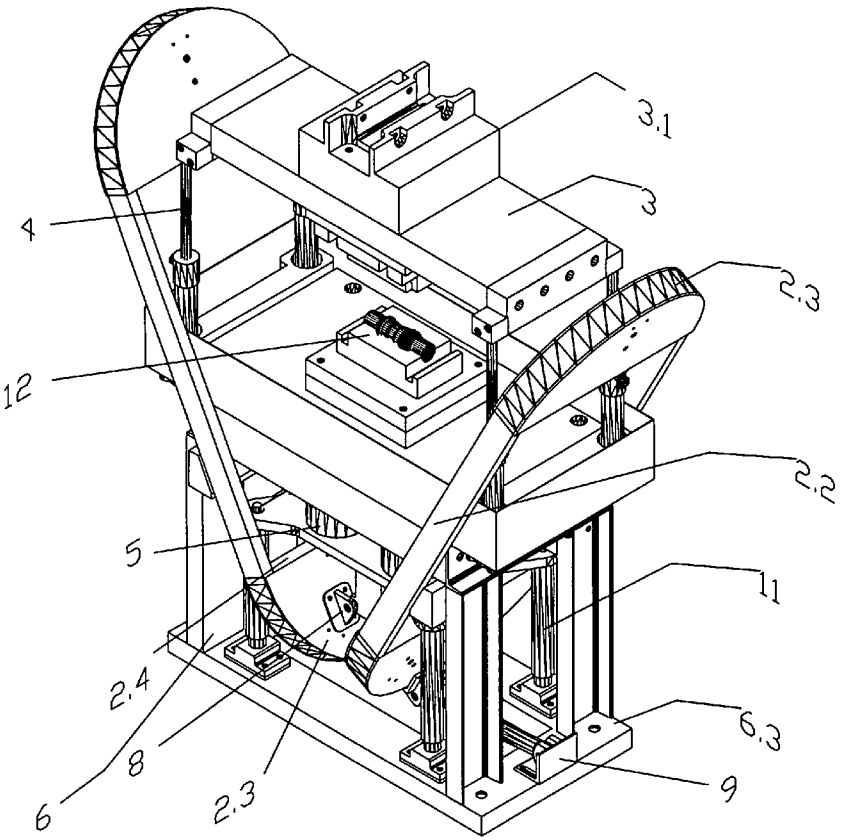
Figures 3A, 3B:
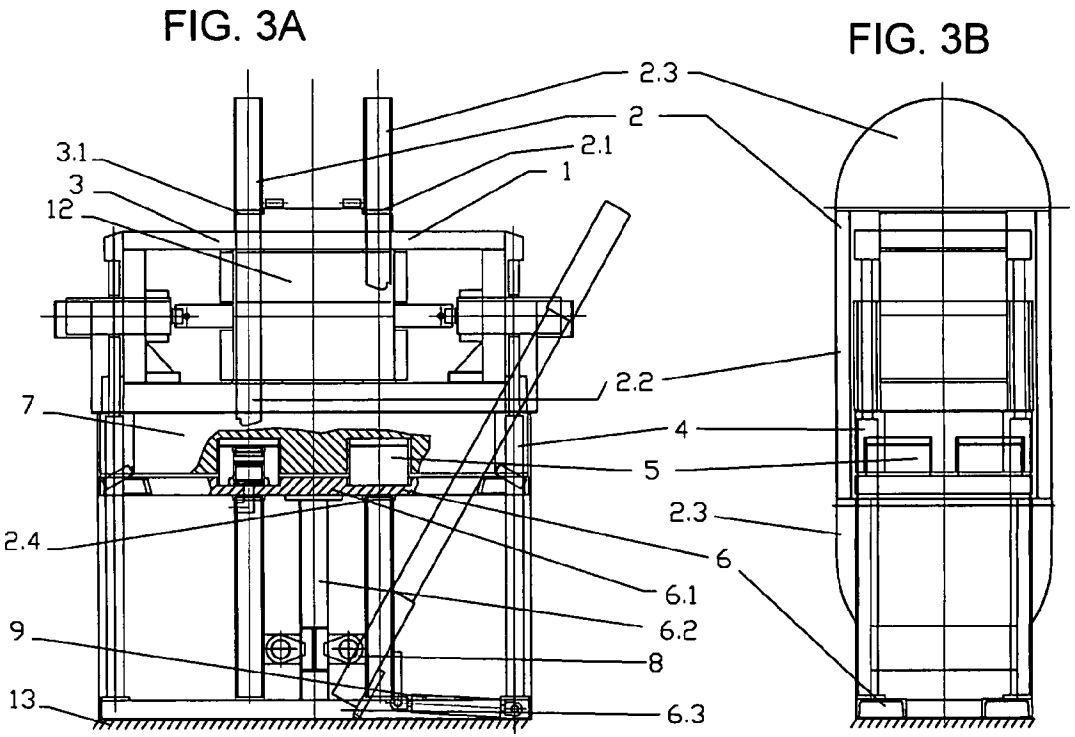

FIG. 2*a* Perspective view of an alternative scenario of the clamping device with a closed forming tool FIG. 2*b* Perspective view of a clamping device with an opened forming tool FIG. 3*a* Side view of a component part for a clamping device FIG. 3*b* Another side view of component part for a clamping device as in FIG. 3*a*

FIG. 1 shows a side view of a clamping device 1 under the invention which is a constituent part of a device for the production of metal parts by hydroforming which contains a two-part forming tool 12. A machine base 6 is secured on a foundation 13, the machine base substantially consisting of a box-shaped structural steel construction. A frame 6.3 is bolted down to another frame 6.1 by means of a column 6.2. The column 6.2 is provided with two articulated joints 8 which are rigidly mounted in the direction of the longitudinal axis of the machine base 6. The two tension hoops 2 are so linked to the articulated joints 8 that these tension hoops 2 can be pivoted in an almost parallel way to the longitudinal axis of the machine base 6. Two hydraulic pivoting cylinders 9 which are located on the frame 6.3 activate the pivoting motion of the tension hoops 2. The four corners of frame 6.3 are provided with four lifting cylinders 4 which rest on the frame 6.3 and are connected to crossbeam 3.

Crossbeam 3 is provided with plane bearing surfaces 3.1 on which the equally plane bearing surfaces 2.1 belonging to tension hoops 2 which are arranged parallel to those can rest when they are positioned. The upper part of the two-part parted-in-length forming tool 12 is mounted to the Crossbeam 3. The lower part of the forming tool 12 is bolted down to machine table 7. The machine table 7 loosely sits on the piston bearing surfaces of the four pressing cylinders which constitute the power-generating elements of device 5.

The pressing cylinders are mounted to the frame 6.1 so that these power-generating elements of device 5 acting on the same tension hoop 2, preferably comprising several hydraulic high-pressure cylinders, are arranged so that the central power-applying lines generated by these power-generating elements of device 5 run almost parallel and along a plane which is not substantially different from the plane separating the tension hoop 2 in an axial direction. The segments 2.3 are largely constructed from some light metal material, such as aluminium alloys. The tension frames 2.2 mainly consist of a carbon fibre compound, e.g. an intermodular fiber of a volume portion of fibres of approx. 50/65% in an epoxy resin matrix.

The functional sequence of the above device is described in its context in the following.

After placing the workpiece into the opened forming tool 12, the latter is closed by lowering the pistons of lifting cylinders 4 until both parts of forming tool 12 come to rest. The pivoting cylinders 9 are now used to pivot the two tension hoops 2 to the vertical condition in order to create a gap which is necessary to allow a contact-free positioning of tension hoops 2, the gap being located between the bearing surfaces 3.1 of crossbeam 3 and the bearing surfaces 2.1 of the tension hoops 2. The pressing cylinders are now used to apply clamping forces on to forming tool 12 along machine table 7. The machine table 7 and the whole forming tool 12 are now lifted until the contact is made between the bearing surfaces of crossbeam 3 and the tension hoops 2. Both parts of the forming tool 12 are then subjected to the required clamping force, which results in the forming tool 12 being clamped.

FIG. 2 shows an alternative scenario of the clamping device with the opened die in a perspective view (FIG. 2*a* and/or FIG. 2*b*). The machine base 6 mainly consists of a box-shaped steel construction. A bottom frame 6.3 is bolted down to another frame 6.1 by means of four vertically arranged beams. A tension hoop beam 10 which is connected with four spring guides 11 to the frame 6.3 is mounted between these two frames. The two articulated joints 8 are mounted to tension hoop beam 10. The articulated joints 8 are provided with the two tension hoops 2 which are linked to their lower ends in order to enable these to pivot parallel to the longitudinal axis of the machine base 6. Two hydraulic pivoting cylinders 9 which are located on frame 6.3 are used for the pivoting of the tension hoops 2. The four corners of frame 6.1 are provided with four vertically arranged lifting cylinders 4 which are connected to crossbeam 3. Crossbeam 3 is provided with plane bearing surfaces 3.1 on which the equally plane bearing surfaces 2.1 arranged parallel to those of tension hoops 2 can rest when they have been positioned (FIG. 2*a*). The two tension hoops 2 each consist of two semicircular segments 2.3 arranged opposite each other, the almost semicircular contours of the upper and lower segment 2.3 each facing different directions. The annular rigid tension hoop 2.2 wraps around the semicircular contours of the upper and lower segment 2.3 and is connected to these. The upper part of the two-part forming tool 12 is fixed to crossbeam 3. The lower part of the forming tool 12 is bolted down to frame 6.1 to the base of which the four pressing cylinders 5 protruding downwards are mounted. The pressing cylinders 5 will move through the four openings of the tension hoop beam 10 and press down on the bearing surfaces 2.4 of the lower segments 2.3 (?). The pressing cylinders are mounted to the frame 6.1 so that the central power-applying lines generated by these power-generating elements of device 5 run almost parallel and along a plane which is not substantially different from the plane parting the tension hoop 2 in an axial centerline direction when tension hoop 2 is positioned (FIG. 2*a*).

The functional sequence of the above device is described in its context in the following:

After placing the workpiece into the opened forming tool 12, the latter is closed by lowering the lifting cylinders 4 until both parts of forming tool 12 come to rest. The pivoting cylinders 9 are now used to pivot the two tension hoops 2 to their vertical position in order to create a gap which is necessary to allow a contact-free positioning of tension hoops 2, the gap being located between the bearing surfaces 3.1 of crossbeam 3 and the bearing surfaces 2.1 of the tension hoops 2. The pressing cylinders are now used to apply forces on to the bearing surfaces 2.4 of the tension hoops 2. Tension hoop 2 is lowered until the bearing surfaces 3.1; 2.1 of the crossbeam 3 and the tension hoop 2 come into contact. The required clamping force which is applied by the pressing cylinders is now applied so that the forming tool 12 is clamped with the help of these clamping forces and the parts of forming tool 12 can no longer open during the forming process.

FIG. 3 contains a side view of a component part for a clamping tool 1 as a constituent part of a device for the production of metal parts by hydroforming which is provided with a two-part forming tool 12. A machine base 6 is bolted down to a foundation 13, the machine base mainly consisting of a box-shaped construction made of structural steel. A frame 6.3 is bolted down to another frame 6.1 by means of a column 6.2. The column 6.2 is provided with two articulated joints 8 which are rigidly mounted in the direction of the longitudinal axis of the machine base 6. The two tension hoops 2 and therefore a pair of the design structure described in the invention are linked to the articulated joints 8 in a manner that these tension hoops 2 can be pivoted in a almost parallel way to the longitudinal axis of the machine base 6.

As an alternative scenario which is not described in FIG. 3 the tension hoop 2 can be located so that it can be axially shifted towards tool 12.

Two hydraulic pivoting cylinders 9 which are mounted to the frame 6.3 are used to activate the pivoting motion of the tension hoops 2. The four corners of frame 6.3 are provided with four lifting cylinders 4 which rest on the frame 6.3 and are connected to crossbeam 3. Crossbeam 3 is provided with plane bearing surfaces 3.1 on which the equally plane bearing surfaces 2.1 belonging to tension hoops 2 which are arranged parallel to those can rest when they have been positioned. The upper part of the two-part parted-in-length forming tool 12 is mounted to the Crossbeam 3. The lower part of the forming tool 12 is bolted down to machine table 7. The machine table 7 loosely sits on the piston bearing surfaces of the four pressing cylinders which constitute the power-generating elements of device 5. The pressing cylinders are mounted to the frame 6.1 in such a way that these power-generating elements of device 5, preferably several hydraulic high-pressure cylinders, acting on the same tension hoop 2 are arranged so that the clamping force or the clamping forces act on the tension hoop 2 in such a way that the net force of the power-applying lines runs almost parallel and along a plane which is not substantially different from the plane parting the tension hoop 2 in a centerline axial direction. The segments 2.3 are largely constructed from some light metal material, such as aluminium alloys. The tension frames 2.2 mainly consist of a nonmetal compound material with embedded reinforcements, here of a carbon fibre compound, e.g. an intermodular fiber of a volume portion of fibres of approx. 50/65% in an epoxy resin matrix.

The functional sequence of the above device is described in its context in the following:

After placing the workpiece into the opened forming tool 12, the latter is closed by lowering the lifting cylinders 4 until both parts of forming tool 12 come to rest. The pivoting cylinders 9 are now used to pivot the two tension hoops 2 to their vertical position in order to create a gap which is necessary to allow a contact-free positioning of tension hoops 2, the gap being located between the bearing surfaces 3.1 of crossbeam 3 and the bearing surfaces 2.1 of the tension hoops 2. The pressing cylinders are now used to apply the clamping forces on to the forming tool 12 along the machine table 7. The machine table 7 and the whole forming tool 12 are lifted until the contact is made between the bearing surfaces of crossbeam 3 and the tension hoops 2. Both parts of the forming tool 12 are now subjected to the required clamping force, which results in the forming tool 12 being clamped.

The component part described in the invention can also be used as an integral element of a clamping tool for the forming or interior forming of plastic, metal, ceramic or glass parts.

The workpiece can be formed inside by blow moulding or injection moulding of larger plastic parts, for instance. The structural unit described in the invention, provided with one or several components described in the invention, could be used for the gap-free closing of a two-part blow mould. The principle of the invention can easily be transferred by a specialist engineer according to known procedures after having adjusted the usual parameters.

A further example for the use of the invention due to its principle is offered by the casting of metal, ceramic or glass parts according to known procedures.

The invention claimed is:

1. A clamping device for a closed forming tool, comprising:

a plurality of tension loops each having at least one tension frame with a closed contour, said tension frame having two mutually opposite segments each formed with at least one bearing surface and spaced apart at a spacing distance for receiving a forming tool therebetween, said tension loops being pivotally disposed about at least one articulated joint, and a material of said tension frame primarily consisting of a reinforced compound;

a bearing surface disposed above or on an upper surface of the forming tool for supporting said bearing surface of a respective said tension loop; and a device for generating a clamping force of more than 3 MN, said device including a plurality of force-generating elements, and wherein the clamping force is applied between said bearing surface of each said tension loop and at least one surface area beneath the forming tool.

2. The clamping device according to claim 1, wherein the material of said tension frame primarily consists of materials having a tensile strength between 1500 $N/mm^2$ and 4200 $N/mm^2$, an endurance strength of between 1200 $N/mm^2$ and 3000 $N/mm^2$ and a density of between 1.2 $g/cm^3$ and 2.5$g/cm^3$.

3. The clamping device according to claim 1, wherein said device for generating the clamping force is disposed between said bearing surfaces of said tension loops and directly on the forming tool.

4. The clamping device according to claim 1, wherein the device for generating the clamping force is located between said bearing surfaces of said tension loops and indirectly on the forming tool.

5. The clamping device according to claim 1, wherein said force-generating elements of the device on the same tension loop being arranged so that central force-applying lines of said force-generating elements of the device run substantially parallel and along a plane that is not substantially different from a plane axially parting said tension loop along a centerline thereof.

6. The clamping device according to claim 5, wherein said force-generating elements of the device are one or a plurality of hydraulic high-pressure cylinders.

7. The clamping device according to claim 1, wherein at least one of said tension loops is movably disposed to shift towards the forming tool in an axial direction.

8. The clamping device according to claim 1, wherein said tension frame consists essentially of a nonmetal compound material with embedded reinforcements.

9. The clamping device according to claim 8, wherein said tension frames consist essentially of a carbon fiber compound.

10. The clamping device according to claim 9, wherein said carbon fiber compound comprises an intermodular fiber of a volume portion of fibers of approximately 50-65% in an epoxy resin matrix.

11. A device for producing metal parts by hydroforming, at least comprising a parted forming tool configured for hydroforming the metal parts and a clamping device according to claim 1.

12. A component part for a clamping device of an apparatus for producing plastic, metal, ceramic, or glass parts by forming processes with a closed forming tool, the component part comprising:

a tension loop having at least one tension frame with a closed contour, said tension frame having two mutually opposite segments each formed with at least one bearing surface and spaced apart at a spacing distance for receiving a forming tool therebetween, and a material of said tension frame primarily consisting of a reinforced compound;

said bearing surface corresponding with a bearing surface above or beneath the tool and/or on a surface of the tool, one or a plurality of clamping forces of a total of at least 1 MN being applied to the component and acting between said bearing surface of said tension loop and at least one surface located underneath or above the tool, the clamping force or clamping forces acting on said tension loop such that a resulting force introduction line runs substantially parallel and in a plane that does not substantially differ from a plane parting said tension loop in a centerline axial direction thereof; and wherein said tension loop is connected to at least one articulated joint enabling said tension loop to pivot towards the tool.

13. A component part for a clamping device of an apparatus for producing plastic, metal, ceramic, or glass parts by forming processes with a closed forming tool, the component part comprising:

a tension loop having at least one tension frame with a closed contour, said tension frame having two mutually opposite segments each formed with at least one bearing surface and spaced apart at a spacing distance for receiving a forming tool therebetween, and a material of said tension frame primarily consisting of a reinforced compound;

said bearing surface corresponding with a bearing surface above or beneath the tool and/or on a surface of the tool, one or a plurality of clamping forces of a total of at least 1 MN being applied to the component and acting between said bearing surface of said tension loop and at least one surface located underneath or above the tool, the clamping force or clamping forces acting on said tension loop such that a resulting force introduction line runs substantially parallel and in a plane that does not substantially differ from a plane parting said tension loop in a centerline axial direction, and wherein said tension loop is mounted for shifting towards the tool.

* * * * *